US008936207B2

(12) United States Patent
Swan

(10) Patent No.: US 8,936,207 B2
(45) Date of Patent: Jan. 20, 2015

(54) BAYONET SYSTEM FOR SPRAY NOZZLES

(75) Inventor: Trevor William Bartlett Swan, Cambridgeshire (GB)

(73) Assignee: Pentair Flow Technologies, LLC, Delavan, WI (US)

( * ) Notice: Subject to any disclaimer, the term of this patent is extended or adjusted under 35 U.S.C. 154(b) by 404 days.

(21) Appl. No.: 12/883,783

(22) Filed: Sep. 16, 2010

(65) Prior Publication Data

US 2011/0095104 A1 Apr. 28, 2011

Related U.S. Application Data

(60) Provisional application No. 61/243,138, filed on Sep. 16, 2009.

(51) Int. Cl.

| | |
|---|---|
| ***B05B 1/00*** | (2006.01) |
| ***B05B 15/06*** | (2006.01) |
| ***B05B 7/04*** | (2006.01) |
| ***B05B 15/00*** | (2006.01) |
| ***B05B 15/02*** | (2006.01) |
| *B05B 1/14* | (2006.01) |

(52) U.S. Cl.

CPC ..... *B05B 15/065* (2013.01); *B05B 7/0425* (2013.01); *B05B 15/008* (2013.01); *B05B 15/02* (2013.01); *B05B 15/068* (2013.01); *B05B 1/14* (2013.01)

USPC ..... 239/600; 239/589

(58) Field of Classification Search

CPC ..... B05B 15/06

USPC ..... 239/589, 590, 591, 597, 600, 532; 285/414, 415, 419, 400, 921

See application file for complete search history.

(56) References Cited

U.S. PATENT DOCUMENTS

| | | | | |
|---|---|---|---|---|
| 4,197,872 | A | 4/1980 | Parker | |
| 4,438,884 | A | 3/1984 | O'Brien et al. | |
| 4,527,745 | A | 7/1985 | Butterfield et al. | |
| 4,690,334 | A | 9/1987 | Dalton | |
| 4,738,401 | A | 4/1988 | Filicicchia | |
| 4,820,285 | A | 4/1989 | Leise et al. | |
| 4,869,428 | A | 9/1989 | Gombar | |
| 5,190,224 | A | 3/1993 | Hamilton | |
| 5,199,649 | A * | 4/1993 | Tolboll | 239/600 |
| 5,421,522 | A | 6/1995 | Bowen | |
| 5,487,507 | A * | 1/1996 | McDonald et al. | 239/391 |
| 5,727,739 | A | 3/1998 | Hamilton | |
| 6,698,672 | B1 * | 3/2004 | Linkletter et al. | 239/526 |
| 6,908,123 | B2 * | 6/2005 | Le | 285/402 |
| 2002/0089175 | A1 | 7/2002 | Ericksen | |
| 2007/0006380 | A1 | 1/2007 | Huang | |
| 2007/0095956 | A1 | 5/2007 | Swan et al. | |

FOREIGN PATENT DOCUMENTS

| | | |
|---|---|---|
| EP | 0080856 | 8/1983 |
| GB | 2274495 | 7/1994 |
| WO | WO97/33698 | 9/1997 |

* cited by examiner

*Primary Examiner* — Davis Hwu

(74) *Attorney, Agent, or Firm* — Quarles & Brady LLP

(57) ABSTRACT

Embodiments of the invention provide a bayonet system for attaching a nozzle body to a nozzle turret. The bayonet system can be rotated with respect to a spray nozzle. A seal can be positioned between the spray nozzle and the nozzle turret. The seal can be compressed by moving the bayonet system without exerting any substantial torsion force on the seal. The bayonet system can help prevent unintentional disengagement of the spray nozzle.

23 Claims, 4 Drawing Sheets

BAYONET SYSTEM FOR SPRAY NOZZLES

RELATED APPLICATIONS

This application claims priority under 35 U.S.C. §119 to U.S. Provisional Patent Application No. 61/243,138 filed on Sep. 16, 2009, the entire contents of which is incorporated herein by reference.

BACKGROUND

Spray nozzles for agricultural applications are generally removed on a regular basis in order to exchange the type of nozzle tip, to inspect parts, or to remove a clog in the spray nozzle. Conventional spray nozzles are twisted when they are connected to a nozzle turret. The twisting motion exerts a torsion force on a seal between the spray nozzle and the nozzle turret. Over time, the torsion force on the seal can result in the spray nozzle falling off. For agricultural applications, the spray nozzle often includes an extension to deliver a chemical to the roots of crops. The crops themselves can get caught on the extension, which can loosen the spray nozzle.

The manufacturing process for conventional spray nozzles generally requires tooling holes. The tooling holes provide an opening for an ingress of dirt and chemicals. The dirt and chemicals compromise the quality of the seal between the spray nozzle and the nozzle turret, especially in high-pressure applications.

SUMMARY

Some embodiments of the invention provide a bayonet system for attaching a nozzle body to a nozzle turret. The bayonet system can be rotated with respect to a spray nozzle. A seal can be positioned between the spray nozzle and the nozzle turret. The seal can be compressed by moving the bayonet system without exerting any substantial torsion force on the seal. The bayonet system can help prevent unintentional disengagement of the spray nozzle.

DETAILED DESCRIPTION

Figure 1:
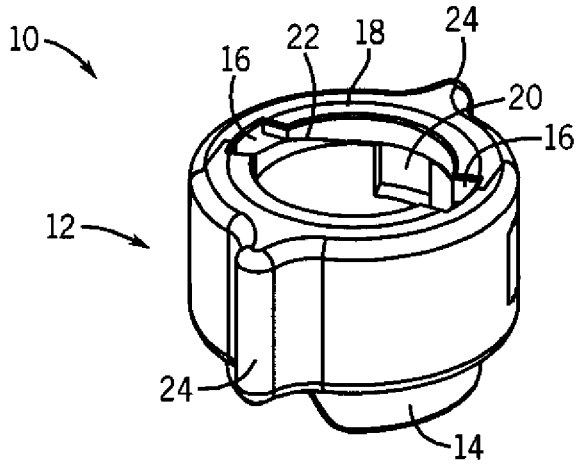
FIG. 1 is a perspective view of a spray nozzle with a bayonet system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a spray nozzle 10 according to one embodiment of the invention. The spray nozzle 10 can include a bayonet system 12 and a nozzle body 14. The bayonet system 12 can include one or more apertures 16 and a flange 18. The nozzle body 14 can include one or more recesses 20. The nozzle body 14 can be manufactured from any suitable material, such as injected-molded plastic and/or ceramics. In some embodiments, the flange 18 can include a ramp 22.

The bayonet system 12 can be moved with respect to the nozzle body 14. In some embodiments, the bayonet system 12 can rotate with respect to the nozzle body 14. The bayonet system 12 can include a handle 24 in order to grasp and rotate the bayonet system 12. The bayonet system 12 can include an open position, in which the apertures 16 can align with the one or more recesses 20 of the nozzle body 14, and a closed position, in which the flange 18 can at least partly cover the recesses 20. In some embodiments, the number of apertures 16 can be identical to the number of the recesses 20.

Figure 2:
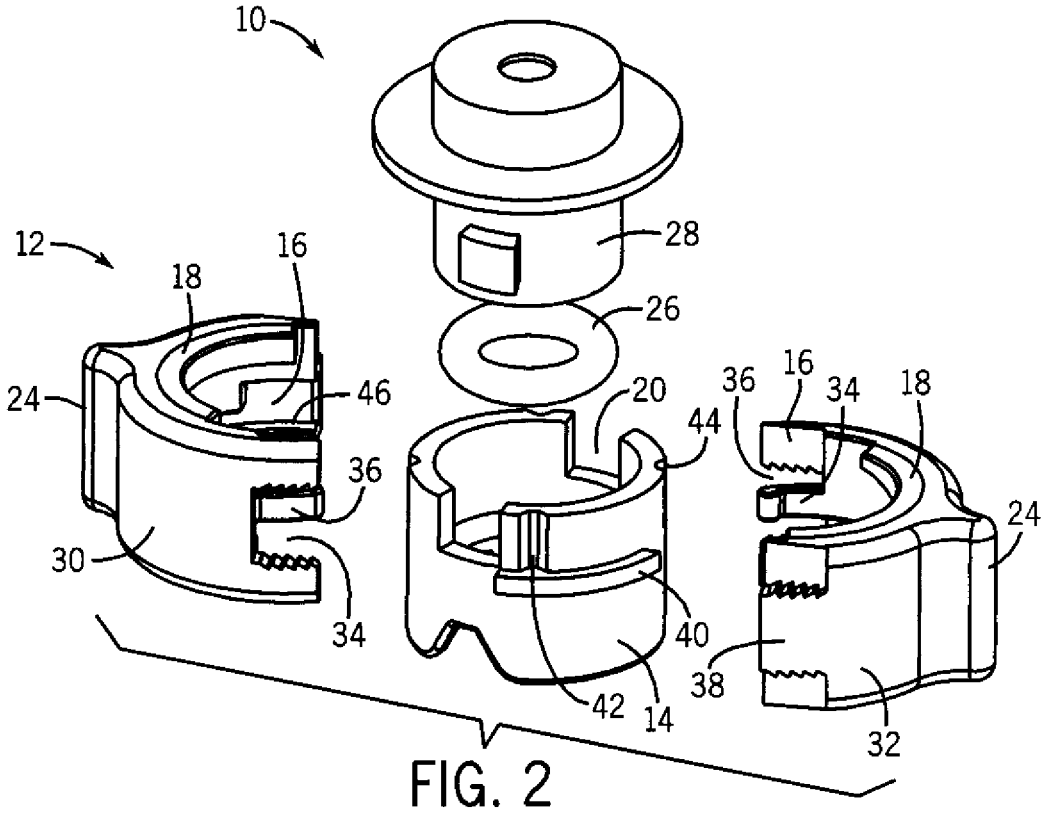
FIG. 2 is an exploded perspective view of the spray nozzle of FIG. 1.

FIG. 2 illustrates the spray nozzle 10 with the bayonet system 12 detached. The spray nozzle 10 can include the bayonet system 12, the nozzle body 14, and a seal 26. The seal 26 can provide a fluid-tight connection between the spray nozzle 10 and a nozzle turret 28. The bayonet system 12 can include a first ring half 30 and a second ring half 32. The first ring half 30 can include the apertures 16, the flange 18, and the handle 24. In some embodiments, the first ring half 30 can include a keyway 34 and a finger 36. The second ring half 32 can include the apertures 16, the flange 18, the handle 24, the keyway 34, the finger 36, and a key 38. In some embodiments, the first ring half 30 can also include the key 38. In some embodiments, the first ring half 30 and the second ring half 32 can be substantially identical. The key 38 of the first ring half 30 can engage the keyway 34 of the second ring half 32 and the key 38 of the second ring half 32 can engage the keyway 34 of the first ring half 30. In some embodiments, the first ring half 30 and the second ring half 32 can be substantially permanently bonded after the first ring half 30 and the second ring half 32 are assembled together.

As shown in FIG. 2, the nozzle body 14 can include a projection 40, a first indent 42, and second indent 44. In some embodiments, the first ring half 30 and the second ring half 32 can each include a groove 46. The projection 40 can engage the groove 46. In some embodiments, the projection 40 and the groove 46 can fix an axial position of the bayonet system 12 with respect to the nozzle body 14, while enabling a rotational movement of the bayonet system 12 with respect to the nozzle body 14. The finger 36 can engage the first indent 42 or the second indent 44 in order to limit a range of movement of the bayonet system 12. In some embodiments, the first indent 42 can correlate to the open position of the bayonet system 12 and the second indent 44 can correlate to the closed position of the bayonet system 12.

To assemble the spray nozzle 10, the first ring half 30 of the bayonet system 12 can be aligned with the nozzle body 14 by engaging the groove 46 with the projection 40. The second ring half 32 can then be snapped into engagement with the first ring half 30. In some embodiments, the first ring half 30 and second ring half 32 can be identical in order to reduce manufacturing costs.

In some embodiments, the first ring half 30 and the second ring half 32 can eliminate the need for tooling holes and/or any other apertures, which can collect dirt and/or the fluid being dispensed by the spray nozzle 10. In some embodiments, the bayonet system 12 can substantially prevent dirt from reaching the seal 26. As a result, the seal 26 can last over extended periods of time without failing.

Figure 3A:
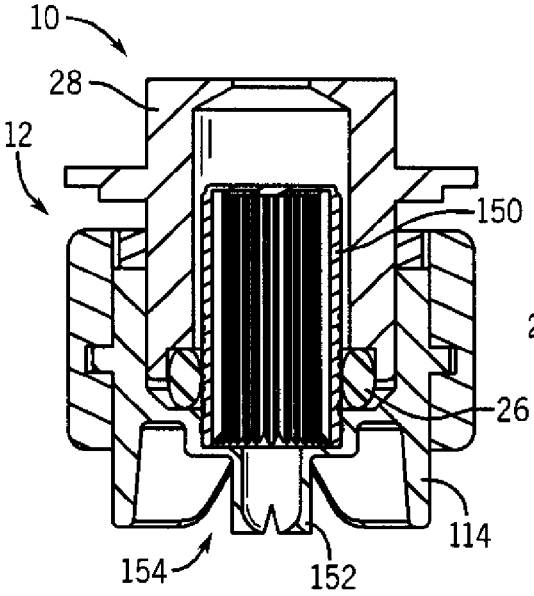
FIGS. 3A-3D are cross-sectional views of different spray nozzles for use with the bayonet system according to some embodiments of the invention.

FIGS. 3A-3D illustrate different embodiments of nozzle bodies 14 that can be used with the bayonet system 12. As shown in FIG. 3A, the spray nozzle 10 can include the bayonet system 12, the seal 26, a nozzle body 114, and a strainer 150. The nozzle body 114 can also include a nozzle tip 152. Fluid being supplied from the nozzle turret 28 can pass through the strainer 150 and exit the spray nozzle 10 through the nozzle tip 152. The strainer 150 can collect particles from the fluid and can help prevent the nozzle tip 152 from clogging. The nozzle tip 152 can be positioned on a substantially uniform section. In some embodiments, the nozzle tip 152 can be surrounded by a substantially void space 154. In some embodiments, the void space 154 can isolate the nozzle tip 152 from other components of the spray nozzle 10. In some embodiments, the void space 154 can facilitate manufacturing of the nozzle tip 152.

Figure 3B:
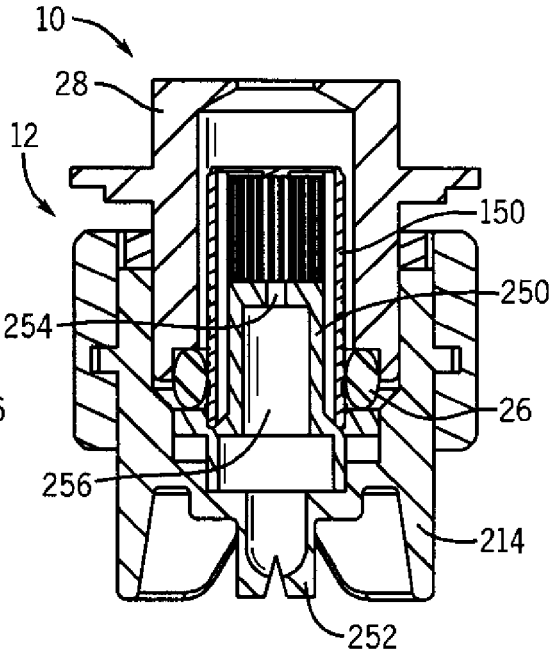

FIG. 3B illustrates a spray nozzle 10 including the bayonet system 12, the seal 26, the strainer 150, and a nozzle body 214. The nozzle body 214 can include a pre-orifice insert 250 and a nozzle tip 252. The pre-orifice insert 250 can include an opening 254 and a chamber 256. The pre-orifice insert 250 can at least partially extend into the strainer 150. The fluid supplied from the nozzle turret 28 can pass through the strainer 150 and can enter the chamber 256 through the opening 254. The chamber 256 can be in fluid communication with the nozzle tip 252 so that the fluid can exit the spray nozzle 10 through the nozzle tip 252.

Figure 3C:
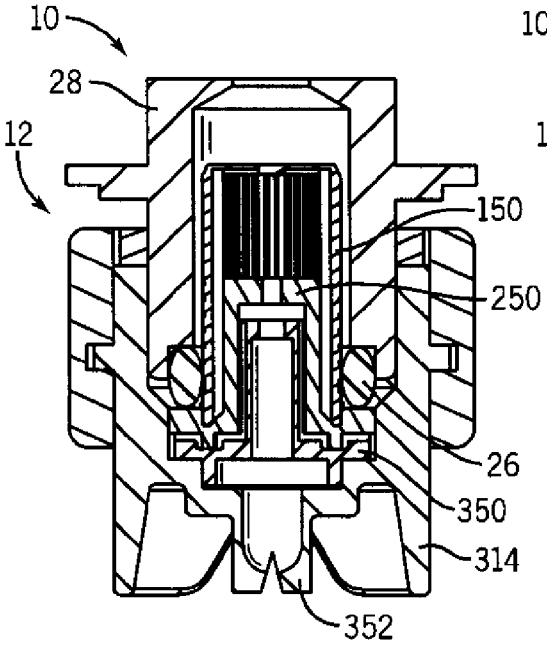

FIG. 3C illustrates a spray nozzle 10 including the bayonet system 12, the seal 26, the strainer 150, the pre-orifice insert 250, a nozzle body 314, and an air-inclusion orifice insert 350. The nozzle body 314 can include a nozzle tip 352. The air-inclusion orifice insert 350 can be at least partially enclosed by the pre-orifice insert 250. The fluid supplied from the nozzle turret 28 can pass the strainer 150 and can enter the pre-orifice insert 250. The fluid can continue to flow from the pre-orifice insert into the air-inclusion orifice insert 350, which can mix air with the fluid. The fluid-air mixture can exit the spray nozzle 10 through the nozzle tip 352.

Figure 3D:
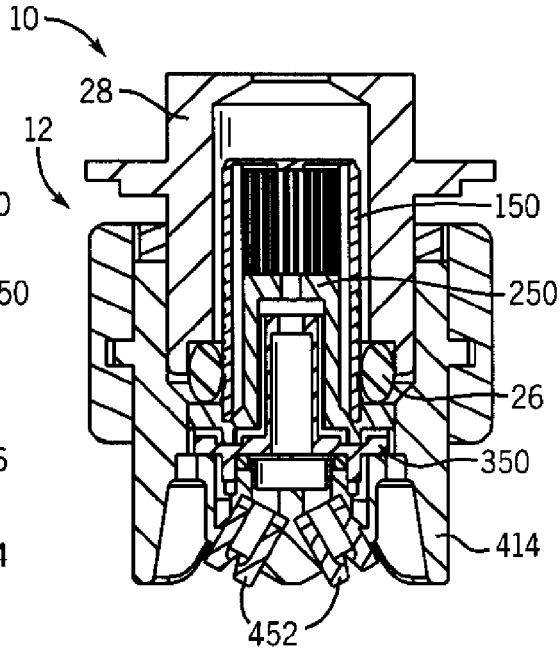

FIG. 3D illustrates a spray nozzle 10 including the bayonet system 12, the seal 26, the strainer 150, the pre-orifice insert 250, the air-inclusion orifice insert 350, and a nozzle body 414. The nozzle body 414 can include two or more nozzle tips 452. In some embodiments, the nozzle tips 452 can be separately manufactured and can be attached into the nozzle body 414.

In some embodiments, the bayonet system 12 can attach the spray nozzle 10 to the nozzle turret 28 regardless of a configuration of the type of spray nozzle 10. For example, the bayonet system 12 can couple the spray nozzle 10 to the nozzle turret 28 regardless of which nozzle body 114, 214, 314, 414 and/or which additional components, such as, e.g., the strainer 150, the pre-orifice insert 250, and the air-inclusion orifice insert 350, are included in the spray nozzle 10. The bayonet system 12 can attach the spray nozzle 10 to the nozzle turret 28 substantially without exerting a torsion force on the seal 26. The bayonet system 12 can attach the spray nozzle 10 to the nozzle turret 28 without interfering with the sealing characteristics of the seal 26, which extends the life span of the seal 26. In some embodiments, the bayonet system 12 can result in superior sealing characteristics of the seal 26.

Figure 4C:
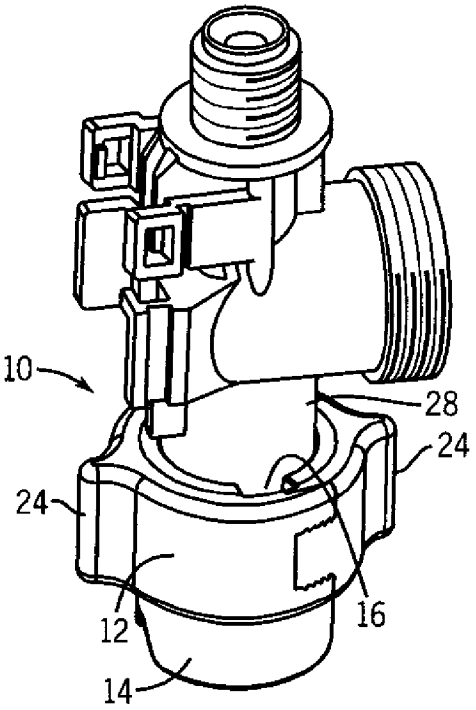
FIGS. 4A-4C illustrate a method of attaching a spray nozzle to a nozzle turret with the bayonet system according to one embodiment of the invention.
Figure 4B:
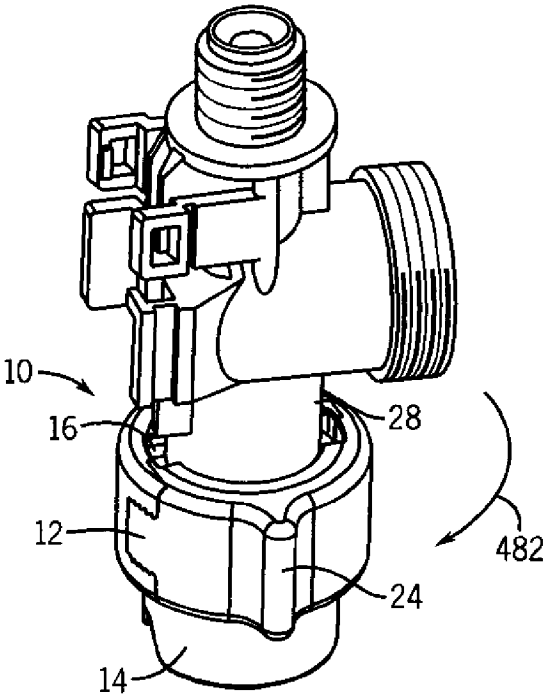
Figure 4A:
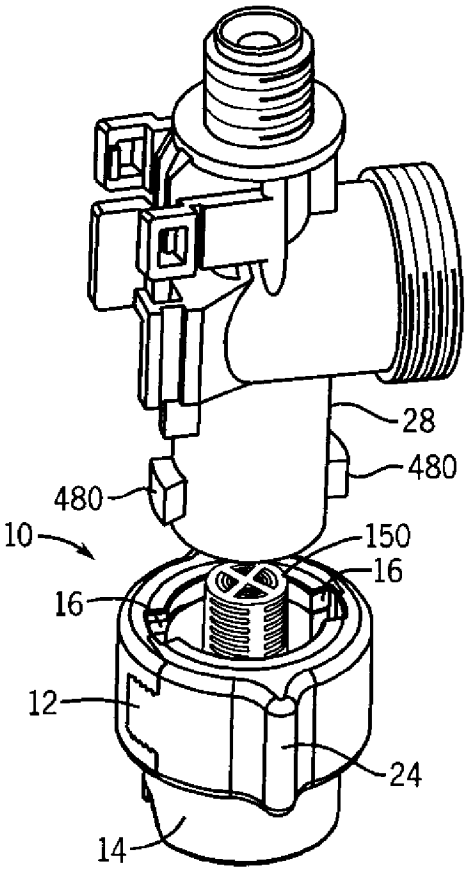

FIGS. 4A-4C illustrate a method of attaching the spray nozzle 10 to the nozzle turret 28. As shown in FIG. 4A, the nozzle turret 28 can include one or more lugs 480. In some embodiments, the number of lugs 480 can be identical to the number of apertures 16 and/or the number of recesses 20. The apertures 16 can align with the lugs 480, and the strainer 150 can be aligned with the nozzle turret 28.

As shown in FIG. 4B, the spray nozzle 10 can then be coupled to the nozzle turret 28. The lugs 480 can pass through the apertures 16 and can be received by the recesses 20. The bayonet system 12 can be rotated by grasping the handle 24, as indicated by arrow 482. Although not shown in FIG. 4B, the finger 36 can disengage the first indent 42, and the ramp 22 can engage the lugs 480. The ramp 22 can pull the spray nozzle 10 toward the nozzle turret 28. In some embodiments, rotating the bayonet system 12 can compress the seal 26. In some embodiments, the bayonet system 12 can substantially prevent the exerting of a torsion force on the seal 26.

FIG. 4C illustrates the spray nozzle 10 fully coupled to the nozzle turret 28. The bayonet system 12 can be rotated using the handle 24 until the finger 36 engages the second indent 44. In some embodiments, the second indent 44 can prevent unintentional removal of the spray nozzle 10. The bayonet system 12 can support a proper alignment of the spray nozzle 10 with respect to the nozzle turret 28. In some embodiments, the bayonet system 12 can remain in the proper alignment even if lateral forces are present. In some embodiments, the bayonet system 12 can support an accurate and/or a substantially continuous spray delivery by supporting the alignment and/or reducing the ingress of dirt.

Figure 5:
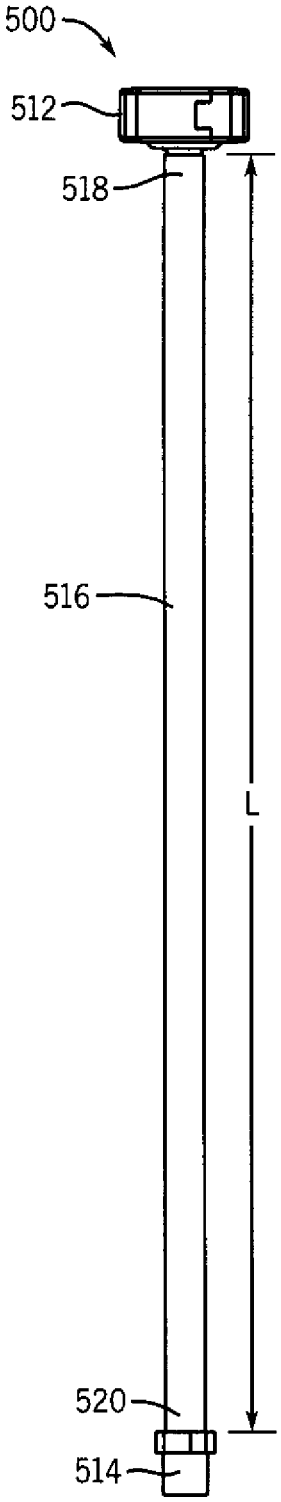
FIG. 5 is a side view of a spray nozzle with the bayonet system including an extension according to one embodiment of the invention.

FIG. 5 illustrates a spray nozzle assembly 500 according to one embodiment of the invention. The spray nozzle assembly 500 can include a bayonet system 512, a nozzle body 514, and an extension 516. The extension 516 can include a first end 518 and a second end 520. The bayonet system 512 can be coupled to the first end 518, and the nozzle body 514 can be coupled to second end 520. The extension 516 can have a length L. In some embodiments, the spray nozzle assembly 500 can be used to deliver chemicals in close proximity to the ground and roots of the crop. In some embodiments, the spray nozzle assembly 500 can be coupled to a vehicle, which, for example, can move through a field of crops. The chemicals can be delivered to the roots of the crop without wetting the ears. The length L can be adjusted depending on the type of crops. In some embodiments, the length L can be about 18 inches. In other embodiments, the length L can be about 24 inches. In some embodiments, the extension 516 can be at least somewhat flexible, while in other embodiments, the extension 516 can be substantially rigid. In some embodiments, the extension 516 can resemble a hose or a tube.

Figure 6:
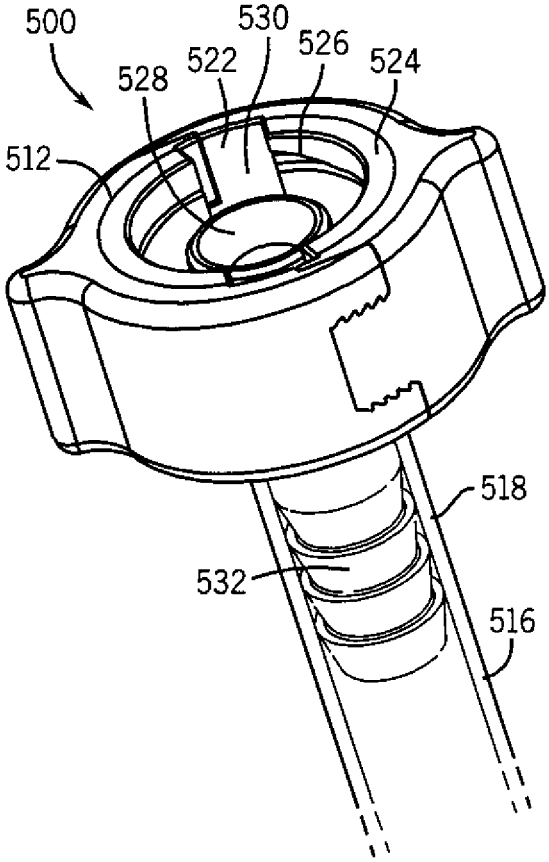
FIG. 6 is a perspective view of a bayonet system of the spray nozzle of FIG. 5.

FIG. 6 illustrates a detailed view of the first end 518 of the spray nozzle assembly 500 according to one embodiment of the invention. A bayonet system 512 can include one or more apertures 522, and a flange 524. In some embodiments, the flange 524 can include a ramp 526. The bayonet system 512 can at least partially enclose an insert 528. The insert 528 can include one or more recesses 530 and a protrusion 532. In some embodiments, the protrusion 532 can be corrugated. In some embodiments, the protrusion 532 can be a hose tail. In some embodiments, the extension 516 can be coupled to the protrusion 532.

The bayonet system 512 can include an open position and a closed position. The bayonet system 512 can be moved between the open position and the closed position with respect to the insert 528. In the open position, the apertures 522 can align with the recesses 530. In the closed position, the flange 524 can at least partially cover the recesses 530. In some embodiments, the bayonet system 512 can be locked in the closed position. In some embodiments, the bayonet system 512 can remain in the closed position even if a lateral force is applied to the insert 528. The bayonet system 512 can remain in the closed position, even if consecutive lateral forces are applied over a period of time. For example, if the spray nozzle assembly 500 is used to spray a field, the crops can get caught on the extension 516 and can exert repeated lateral forces on the insert 528. The bayonet system 512 can help prevent a disengaging of the spray nozzle assembly 500 from disengaging, being damaged, or being lost.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A spray nozzle adapted to be attached to a nozzle turret, the spray nozzle comprising:

a bayonet system including a first ring half and a second ring half that is substantially identical to the first ring half, wherein the first ring half and the second ring half are removably engaged together;

a seal positioned adjacent to the nozzle turret;

a nozzle body;

the bayonet system being rotated to attach the nozzle body to the nozzle turret and to compress the seal between the nozzle body and the nozzle turret without exerting any substantial torsion force on the seal; and the bayonet system including at least one finger and the nozzle body including at least one indent, the at least one finger engaging the at least one indent in order to limit a range of motion of the bayonet system.

2. The spray nozzle of claim 1, wherein the bayonet system includes at least one handle used to rotate the bayonet system until the at least one finger engages the at least one indent on the nozzle body.

3. A spray nozzle adapted to be attached to a nozzle turret, the spray nozzle comprising:

a bayonet system including a first ring half and a second ring half that is substantially identical to the first ring half;

a seal positioned adjacent to the nozzle turret;

a nozzle body;

the bayonet system being rotated to attach the nozzle body to the nozzle turret and to compress the seal between the nozzle body and the nozzle turret without exerting any substantial torsion force on the seal;

the bayonet system including at least one aperture and the nozzle body including at least one recess; and the nozzle turret including at least one lug, the at least one aperture being aligned with the at least one recess when in an open position so that the at least one lug can pass through the at least one aperture to be received by the at least one recess.

4. A spray nozzle adapted to be attached to a nozzle turret, the spray nozzle comprising:

a bayonet system including a first ring half and a second ring half that is substantially identical to the first ring half;

a seal positioned adjacent to the nozzle turret; and a nozzle body;

the bayonet system being rotated to attach the nozzle body to the nozzle turret and to compress the seal between the nozzle body and the nozzle turret without exerting any substantial torsion force on the seal;

the bayonet system including at least one aperture and the nozzle body including at least one recess; and the bayonet system including at least one flange that at least partially covers the at least one recess when in a closed position, the at least one flange including a ramp to engage the at least one lug and pull the nozzle body toward the nozzle turret.

5. The spray nozzle of claim 4, wherein the first ring half and the second ring half each include a key on a first end and a keyway on a second end; wherein the key of the first ring half engages the keyway of the second ring half and the key of the second ring half engages the keyway of the first ring half in order to substantially permanently bond the first ring half to the second ring half.

6. The spray nozzle of claim 4, wherein the nozzle body includes at least one projection; and wherein the first ring half and the second ring half each include a groove to receive the at least one projection.

7. The spray nozzle of claim 4, wherein the bayonet system covers the seal in order to substantially prevent dirt from reaching the seal.

8. The spray nozzle of claim 4, wherein the bayonet system attaches the nozzle body and the seal to the nozzle turret without interfering with sealing characteristics of the seal.

9. The spray nozzle of claim 4, wherein the nozzle body includes at least one of a strainer, at least one nozzle tip, a pre-orifice insert, and an air-inclusion orifice insert.

10. The spray nozzle of claim 4, and further comprising an extension to deliver chemicals in close proximity to roots of a crop; a first end of the extension coupled to the nozzle turret by the bayonet system; and a second end of the extension coupled to the nozzle body.

11. The spray nozzle of claim 10, and further comprising an insert positioned between the extension and the nozzle turret; the insert including at least one corrugated protrusion received by the extension.

12. A method of attaching a spray nozzle to a nozzle turret, the method comprising:

providing a spray nozzle including a bayonet system having a first ring half and a second ring half wherein the first ring half and the second ring half are removably engaged together, a nozzle body, and a seal;

moving the nozzle body in an axial direction toward the nozzle turret;

rotating the bayonet system in a rotational direction without rotating the nozzle body;

compressing the seal by rotating the bayonet system in order to move the nozzle body in the axial direction without exerting any substantial torsion force on the seal; and limiting a range of motion of the bayonet system by engaging at least one indent of the nozzle body with at least one finger of the bayonet system.

13. The method of claim 12, and further comprising aligning at least one aperture of the bayonet system with at least one recess of the nozzle body.

14. The method of claim 12, and further comprising locking the bayonet system in a closed position.

15. The method of claim 12, wherein rotating the bayonet system in the rotational direction moves the spray nozzle in the axial direction.

16. The method of claim 12, and further comprising using at least one handle to rotate the bayonet system until the finger engages the at least one indent on the nozzle body.

17. A method of attaching a spray nozzle to a nozzle turret, the method comprising:

providing a spray nozzle including a bayonet system, a nozzle body, and a seal;

moving the nozzle body in an axial direction toward the nozzle turret;

rotating the bayonet system in a rotational direction without rotating the nozzle body;

compressing the seal by rotating the bayonet system in order to move the nozzle body in the axial direction without exerting any substantial torsion force on the seal; and positioning the bayonet system in an open position by aligning at least one aperture of the bayonet system with at least one lug of the nozzle turret so that the at least one lug can pass through the at least one aperture and can be received by at least one recess of the nozzle body.

18. A method of attaching a spray nozzle to a nozzle turret, the method comprising:

providing a spray nozzle including a bayonet system, a nozzle body, and a seal;

moving the nozzle body in an axial direction toward the nozzle turret;

rotating the bayonet system in a rotational direction without rotating the nozzle body;

compressing the seal by rotating the bayonet system in order to move the nozzle body in the axial direction without exerting any substantial torsion force on the seal; and at least partially covering the at least one recess with the at least one flange of the bayonet system when in a closed position; and pulling the nozzle body toward the nozzle turret with a ramp of the at least one flange.

19. A method of attaching a spray nozzle to a nozzle turret, the method comprising:

providing a spray nozzle including a bayonet system, a nozzle body, and a seal, wherein the bayonet system includes a first ring half and a second ring half each including a key on a first end and a keyway on a second end;

moving the nozzle body in an axial direction toward the nozzle turret;

rotating the bayonet system in a rotational direction without rotating the nozzle body;

compressing the seal by rotating the bayonet system in order to move the nozzle body in the axial direction without exerting any substantial torsion force on the seal;

limiting a range of motion of the bayonet system by engaging at least one indent of the nozzle body with at least one finger of the bayonet system;

engaging the key of the first ring half with the keyway of the second ring half; and engaging the key of the second ring half with the keyway of the first ring half in order to substantially permanently bond the first ring half to the second ring half.

20. A method of attaching a spray nozzle to a nozzle turret, the method comprising:

providing a spray nozzle including a bayonet system, a nozzle body, and a seal, wherein the bayonet system includes a first ring half and a second ring half each including a key on a first end and a keyway on a second end;

moving the nozzle body in an axial direction toward the nozzle turret;

rotating the bayonet system in a rotational direction without rotating the nozzle body;

compressing the seal by rotating the bayonet system in order to move the nozzle body in the axial direction without exerting any substantial torsion force on the seal;

limiting a range of motion of the bayonet system by engaging at least one indent of the nozzle body with at least one finger of the bayonet system;

engaging the key of the first ring half with the keyway of the second ring half;

engaging the key of the second ring half with the keyway of the first ring half in order to substantially permanently bond the first ring half to the second ring half; and receiving at least one projection of the nozzle body within a groove of one of the first ring half and the second ring half.

21. The method of claim 12, and further comprising covering the seal with the bayonet system in order to substantially prevent dirt from reaching the seal.

22. The method of claim 12, and further comprising attaching the nozzle body and the seal to the nozzle turret with the bayonet system without interfering with sealing characteristics of the seal.

23. The method of claim 12, and further comprising attaching an extension to the nozzle turret in order to deliver chemicals in close proximity to roots of a crop; coupling a first end of the extension to the nozzle turret by the bayonet system; and coupling a second end of the extension to the nozzle body.

* * * * *